US005281895A

United States Patent [19]

Suzuki et al.

[11] Patent Number: 5,281,895

[45] Date of Patent: Jan. 25, 1994

[54] TUNING MECHANISM FOR HIGH POWER KLYSTRON HAVING PHOTOINTERRUPTER CONTROL MEANS

[75] Inventors: Wakou Suzuki; Yasuhiro Iwagami, both of Tokyo, Japan

[73] Assignee: NEC Corporation, Tokyo, Japan

[21] Appl. No.: 768,037

[22] Filed: Sep. 30, 1991

[30] Foreign Application Priority Data

Oct. 4, 1990 [JP] Japan ..... 2-104627[U]

[51] Int. Cl.[5] ..... H01J 23/20

[52] U.S. Cl. ..... 315/5.47; 315/5.48; 315/5.53; 315/5.54

[58] Field of Search ..... 315/5.46-5.48, 315/5.53, 5.54; 330/45; 331/83

[56] References Cited

U.S. PATENT DOCUMENTS 3,617,799 11/1971 Schmidt et al. ..... 315/5.47
4,216,409 8/1980 Sato et al. ..... 315/5.46
4,908,549 3/1990 Bres et al. ..... 315/5.46 X

FOREIGN PATENT DOCUMENTS 179389 7/1966 U.S.S.R. ..... 315/5.47

*Primary Examiner*—Benny T. Lee
*Attorney, Agent, or Firm*—Laff, Whitesel, Conte & Saret

[57] ABSTRACT

The channel tuner mechanism for a high power klystron. A plunger support mechanism is connected to each plunger which constitutes a part of a vacuum tube of the klystron for normally applying to the plunger a force in a reverse direction away from the vacuum tube of the klystron. A preset plate has a plurality of protrusions arranged in contact with the plunger support mechanism to impart thereto a mechanical displacement. A drive mechanism is provided for coupling or decoupling the protrusions of the preset plate to and from the plunger support mechanism to which the plungers are connected. A detection unit is provided to detect which protrusion is selectively connected to the plungers.

1 Claim, 6 Drawing Sheets

TUNING MECHANISM FOR HIGH POWER KLYSTRON HAVING PHOTOINTERRUPTER CONTROL MEANS

BACKGROUND OF THE INVENTION

The present invention relates to a channel tuner mechanism for a high power klystron. The high power klystron is comprised of an electron gun for emitting and forming an electron beam, interaction structure for interacting a radio frequency signal with the electron beam, a collector for collecting electrons, and a magnetic focusing for focusing the electron beam. Among them, the interaction structure is comprised of a main part of a cavity, a plunger, and a channel tuner mechanism connecting and supporting the plunger. When varying a frequency of the radio frequency signal to be amplified, it is necessary to adjust adequately resonant frequencies of a plurality of cavities while monitoring repeatedly frequency characteristics of the high power klystron. Therefore, the conventional klystron is inconvenient with respect to maintenance and operation as compared to traveling wave tube which also amplifies an electromagnetic wave.

In order to remove this operational inconvenience, there has been proposed a particular type of the high power klystron provided with a channel tuner mechanism having a preset function effective to easily determine a given frequency band width for preset particular frequencies by a channel switching operation without adjusting the resonant frequencies. This type of the conventional high power klystron provided with such preset function has a construction as shown in FIG. 1.

Namely, in the high power klystron, the interaction structure is comprised of a cavity 1, a plunger 2 for changing a volume of the cavity 1 to vary a resonant frequency, and a piece of bellows 3 connected to both of the plunger 2 and the cavity 1 to expand or contract in order to effect advancing and retracting movement of the plunger 2 while maintaining the vacuum state of the high power klystron. Further, a channel tuner mechanism 4 is comprised of a plunger support mechanism 5 connected to the plunger 2 for moving in a given direction along an axis of the plunger 2, and a preset unit 7 fixed to the interaction structure through a supporting rod 6. The channel tuner mechanism 4 is connected to the plunger 2 so as to vary a resonant frequency of the cavity 1, and this mechanism 4 is comprised of the plunger support mechanism 5 for applying normally to the plunger 2 a force in a reverse direction away from a vacuum tube side of the high power klystron by means of a restoring force of a spring 8, the preset unit 7 including means for displacing in a parallel manner a preset plate 10 which is provided with a plurality of frequency setting screws 9, by rotating a channel select shaft 19 and pinion 11, and a drive mechanism 13 for effecting a coupling and decoupling between the frequency setting screws 9 and tuner shafts 13. FIG. 2 shows a detailed construction of the preset plate 10, pinion 11 and frequency setting screws 9.

In this mechanism, preset operation is carried out as follows in order to preset a predetermined frequency band width in a particular tuning channel of the high power klystron be means of each set of the frequency setting screws 9 disposed along drift tube tips of the cavity. At first in the FIG. 1 state, the adjustment is carried out by the frequency setting screws 9 so as to set a frequency band width in a given channel. Next, a movable plate 17 is displaced to come in contact with an unlock plate 18 by rotating a lock-unlock shaft 16 which is fixed to a fixing plate 15 through a set of bearings 14. At this moment, the tuner shaft 12 connected to the plunger 2 is decoupled from the frequency setting screw 9. In this state, a channel shaft 19 is rotated such that another frequency setting screw 9 is positioned in alignment with a center axis of the tuner shaft 12. In this position, the movable plate 17 is again displaced through the lock-unlock shaft 16 to come in contact with a lock plate 20. In this state, an advancing degree of the frequency setting screw 9 is adjusted to set a predetermined frequency band width characteristic in another channel than the first tuned channel. Such adjustment is repeatedly carried out so as to provisionally set a multiple of tuning channels in the high power klystron.

However, in the above described conventional channel tuner mechanism, it is necessary to provisionally memorize setting data in a memory of an apparatus in which the klystron is mounted as to which channel is tuned in the klystron. The reason is that it is necessary to recognize which channel is selected for tuning of the klystron and to recognize which channel is next selected for tuning of the klystron when channel switching is carried out in the channel tuner mechanism. However, this memorizing method has various drawbacks because a costly memory device is needed, and a memory device of such a complicated construction may cause a failure.

SUMMARY OF THE INVENTION

In order to eliminate drawbacks of the prior art, an object of the present invention is to provide an improved channel tuner mechanism of the high power klystron having low cost and a reduced failure factor.

Basically, the channel tuner mechanism of the high power klystron is comprised of a plunger support mechanism which is connected to each plunger which constitutes a part of a vacuum tube of the high power klystron and which normally applies to the tuning element a force in a reverse direction away from a vacuum tube side of the high power klystron, a preset plate having a plurality of protrusions disposed in contact with at least a part of the tuning element support mechanism to impart thereto a mechanical displacement, and a drive mechanism having means for coupling and decoupling the protrusions of the preset plate and a part of the plunger support mechanism, which is connected to the plungers. Usually, a detection unit is provided for detecting which protrusion comes in contact with the plunger among the plurality of protrusions on the preset plate.

The detection unit is constructed such that a plurality of slits or holes are formed in the preset plate and a plurality of switches are provided in combination with these slits or holes for detecting a channel. This switch is comprised of a photointerrupter composed of a light emitting diode and a photodiode, or is comprised of a contact type switch.

DETAILED DESCRIPTION OF PREFERRED EMBODIMENTS

Figure 1:
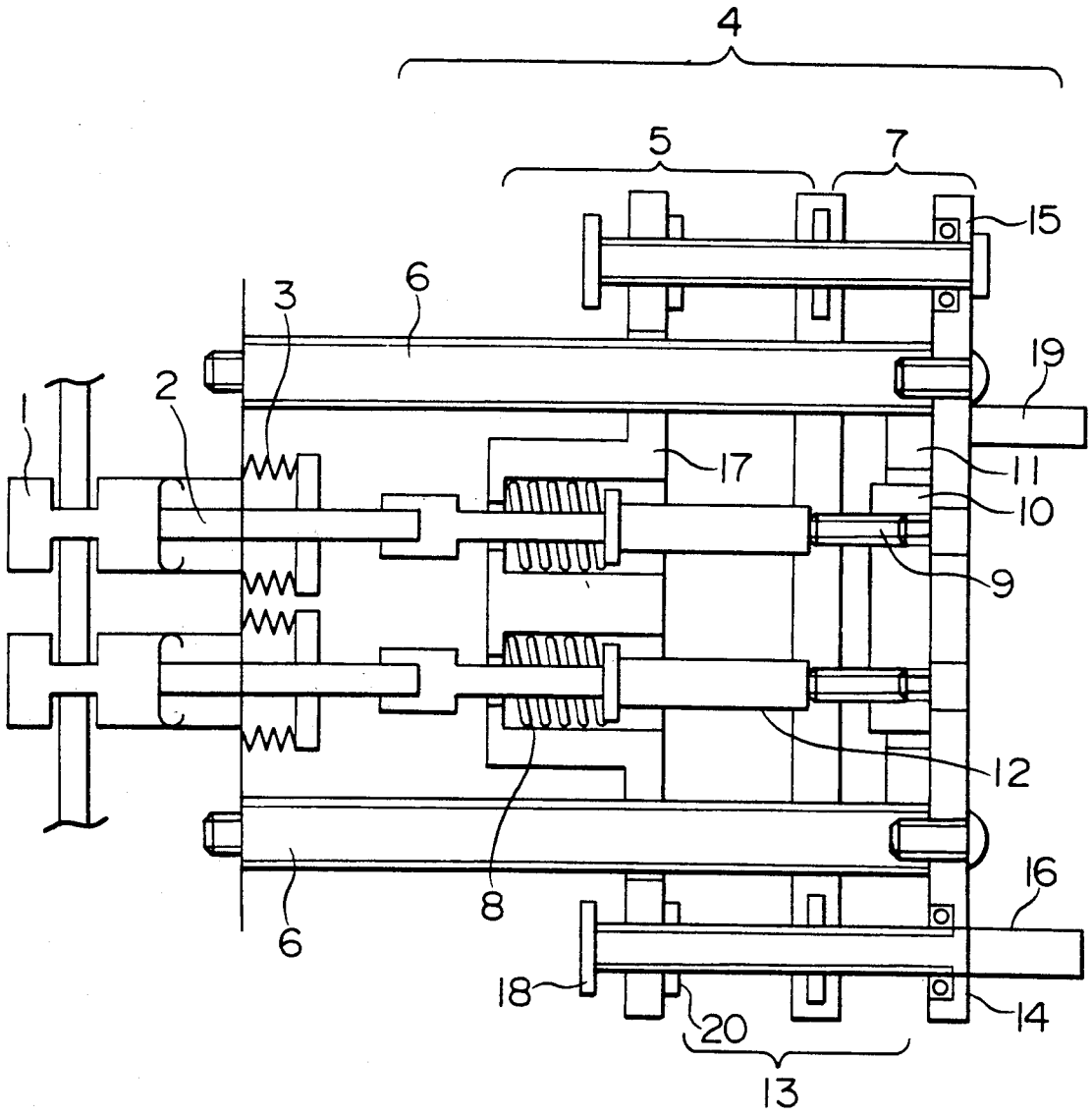
FIG. 1 PRIOR ART
FIG. 1 is a sectional view showing a channel tuner mechanism of the conventional high power klystron.
Figure 2:
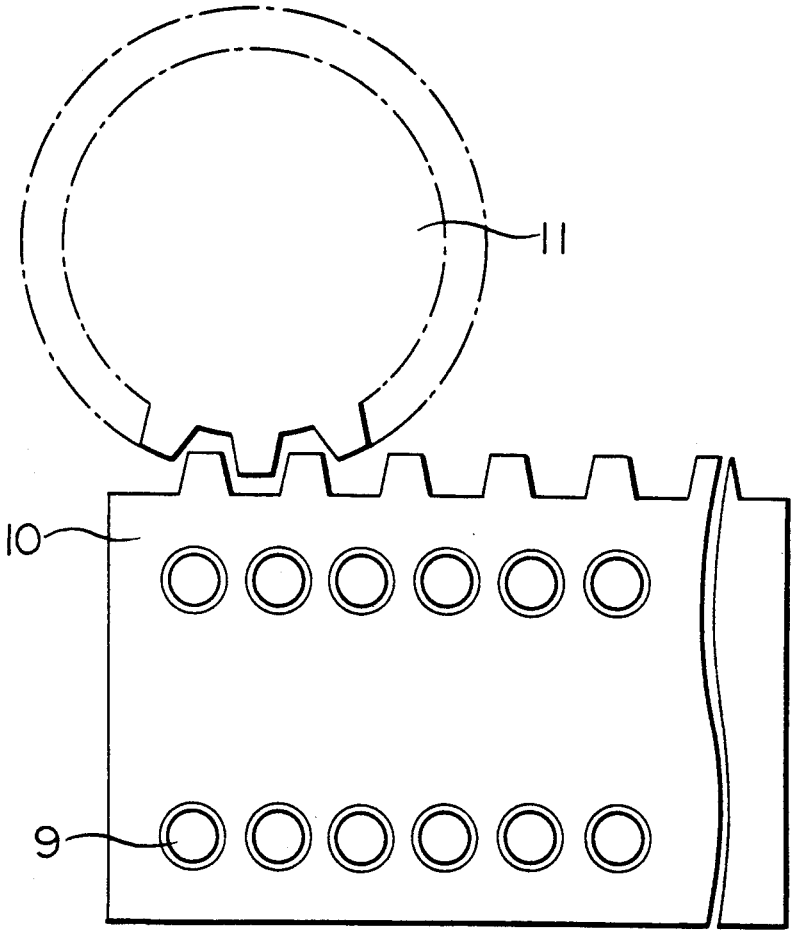
FIG. 2 PRIOR ART
FIG. 2 is a sectional view of a preset plate and a pinion part of the conventional channel tuner mechanism.
Figure 3A:
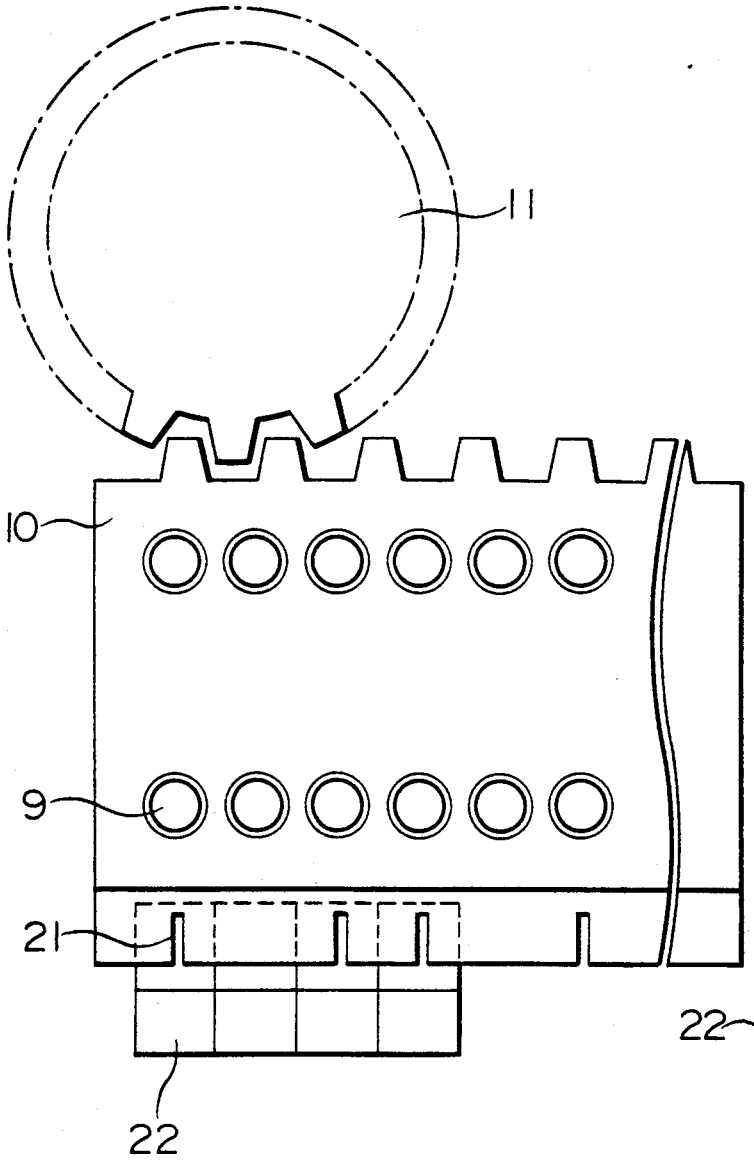
FIGS. 3A and 3B are, respectively, a sectional view and a side view of a first embodiment of the present invention.
Figure 3B:
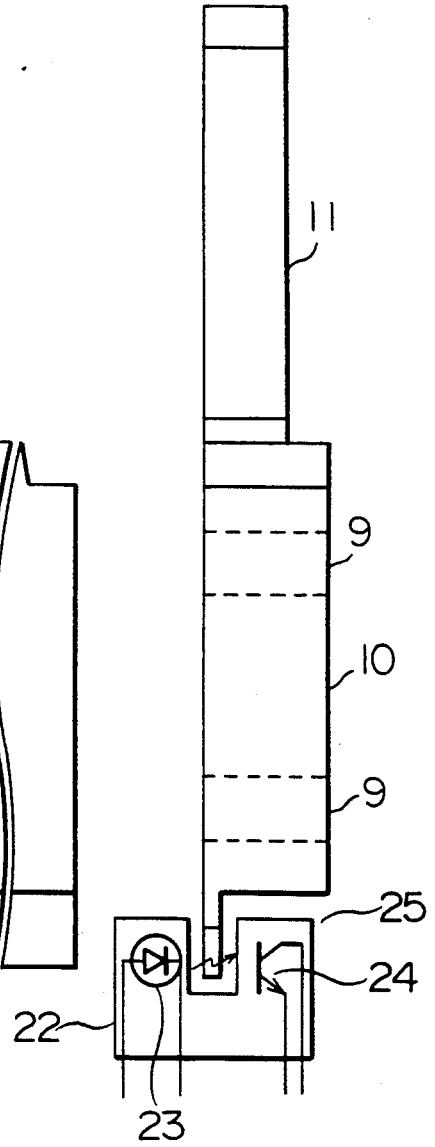

Hereinafter, the present invention will be described in detail with reference to the drawings. FIGS. 3A and 3B are a sectional view and a side view, respectively, of a first embodiment of the present invention, in which the channel tuner mechanism of the high power klystron includes a preset plate 10, a pinion 11, frequency setting screws 9 and a channel detection unit 25 (see FIG. 3B). Slits 21 are formed in a lower portion of the preset plate 10 which supports thereon a plurality of protrusions in the form of frequency setting screws 9 which are connected to plungers which constitute a part of a cavity formed in a vacuum tube of the klystron of the high power klystron. Four photointerrupters 22 each composed of light emitting diode 23 and photodiode 24 are fixed at the same interval as those of the frequency setting screws 9 so as to pass a light through the slits 21. When the light from the emitting diode 23 of the photointerrupter 22 reaches the photodiode 24 (see FIG. 3B) through the slit 21, the photodiode 24 is turned conductive. On the other hand, when the light is blocked, the photodiode 24 is made open. The slits 21 are arranged such that the channel detection unit 25 produces a signal as shown in the following Table 1 for each of the channels, where the signal value 1 denotes the conductive state and the signal value 0 denotes the open state. Namely, in the position of FIG. 3, the preset plate 10 is set to the channel 1 as shown in the Table 1 so that the detection unit produces the signal 1011. When the preset plate 10 is displaced such that another frequency setting screw 9 is connected to a plunger 2 which constitutes a part of the cavity, the channel detection unit 25 generates a signal corresponding to that channel.

TABLE 1

| channel | Signal from tuning channel detection unit | | | |
|---|---|---|---|---|
| channel 1 | 1 | 0 | 1 | 1 |
| channel 2 | 0 | 1 | 1 | 0 |
| channel 3 | 1 | 1 | 0 | 0 |
| channel 4 | 1 | 0 | 1 | 0 |
| channel 5 | 0 | 1 | 0 | 0 |
| channel 6 | 1 | 0 | 0 | 0 |

As described above, according to the present embodiment, the channel can be detected by a simple structure without using a particular memory device.

Figure 4A:
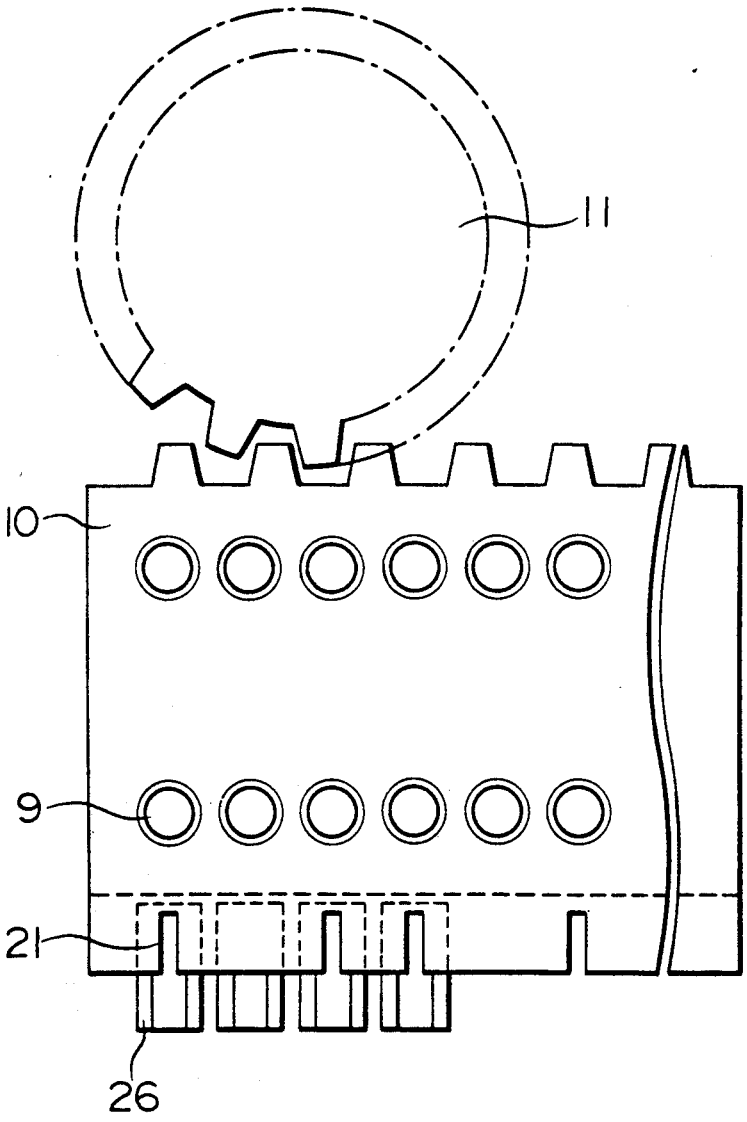
FIGS. 4A and 4B are, respectively, a sectional view and a side view of a second embodiment of the present invention.
Figure 4B:
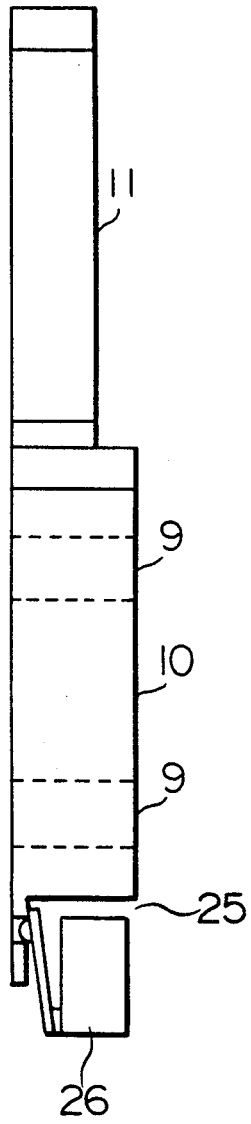

FIGS. 4A and 4B are a sectional view and a side view, respectively, of the second embodiment according to the present invention. The preset plate 10 is constructed in manner similar to the first embodiment. A contact type switch 26 is utilized instead of the photointerrupter. This embodiment contains only a mechanical construction to thereby feature simplicity and convenience.

Figure 5:
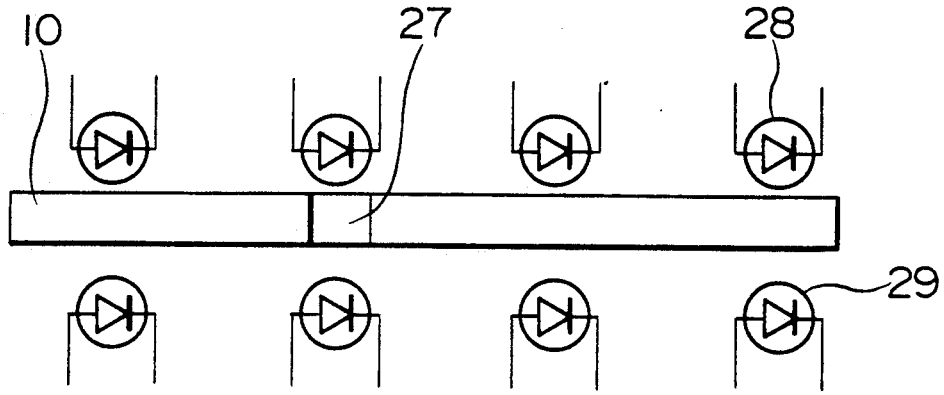
FIG. 5 is a sectional view showing a channel detection unit in a third embodiment of the present invention.
Figure 7:
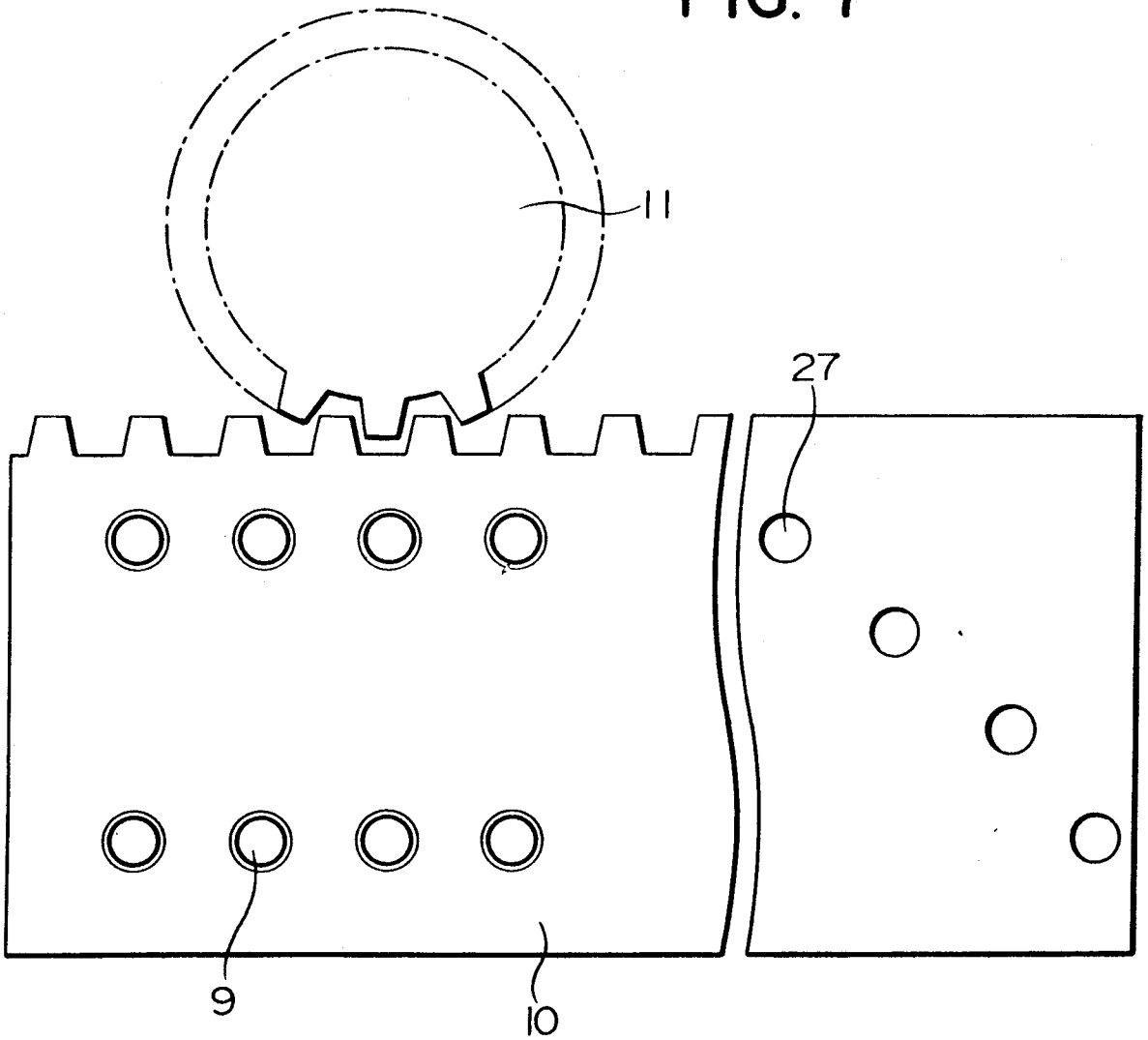
FIG. 7 is a sectional view of a preset plate and a pinion part used in the third and fourth embodiments.

FIG. 5 is a sectional view showing a channel detection unit of the channel tuner mechanism in the third embodiment of the high power klystron according to the invention. FIG. 7 is a plan view showing a preset plate 10, where position detecting holes 27 are formed in registration with the frequency setting screws 9 on the preset plate 10 which supports a plurality of protrusions in the form of the frequency setting screws 9 which are coupled to plungers which constitute a part of each cavity of the high power klystron. The light emitting diodes 28 and protodiodes 29 of FIG. 5 are opposed to each other in alignment with the position detection holes 27 formed on the preset plate 10 of FIG. 7 in registration with each pair of the frequency setting screws corresponding to each channel such that light from the emitting diode can reach the protodiode through the hole of the preset plate. In such construction, when the preset plate 10 is displaced such that another pair of frequency setting screws 9 are coupled to the plungers 2 which constitute a part of the cavity 1, another detection hole 27 formed in a different position is set to another part of the tuning channel detection unit composed of a light emitting diode 28 and a photodiode 29 disposed in a different position. When the light from the emitting diode 28 is received through the position detecting hole 27 by the protodiode 29, the photodiode 29 generates a voltage across its terminals, while the photodiode 29 does not generate a voltage when the light is not received. This voltage is detected to discriminate which frequency setting screw 9 is coupled to the plunger which constitutes a part of the cavity.

Figure 6:
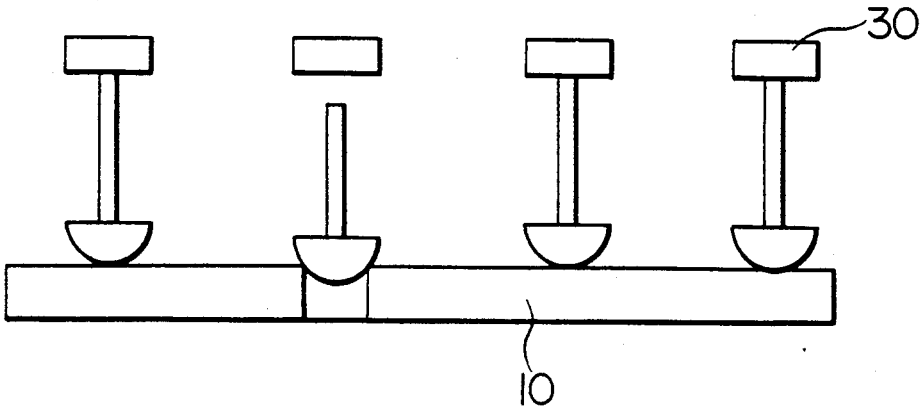
FIG. 6 is a sectional view showing a channel detection unit in a fourth embodiment of the present invention.

FIG. 6 is a sectional view showing a channel detection unit of the fourth embodiment according to the present invention. The preset plate 10 has the same construction as that of the third embodiment shown in FIG. 7. A contact type switch 30 is utilized instead of the light emitting diode and the photodiode.

As described above, according to the present invention, the channel detecting function is provided in the channel tuner mechanism of the high power klystron, thereby eliminating a memory which would be needed in an apparatus utilizing the conventional high power klystron. By such construction, there can be obtained advantages such as cost reduction and failure reduction by eliminating the complicated memory device.

What is claimed is:

1. A channel tuner mechanism for a high power klystron, comprising:

a plunger support mechanism connected to a plurality of plungers, each of said plungers constituting a part of corresponding cavities associated with the klystron;

a preset plate having a plurality of protrusions placed in contact with at least a part of the plunger support mechanism to impart a mechanical displacement thereto, said plate further having a plurality of openings disposed therein to define channel positions;

a drive mechanism for selectively coupling the respective protrusions of the preset plate to said part of the plunger support mechanism to which the corresponding plungers are connected; and a detection unit including a plurality of switches, for cooperating with said openings, for detecting said channel positions of said preset plate, said detection unit detecting which protrusion out of the plurality of protrusions of the preset plate is connected to the plungers; and each of said switches being a photointerrupter comprising a light emitting diode and a photodiode each said light emitting diode and said corresponding photodiode being opposed to each other and in alignment with respective openings so that the respective openings are disposed between said light emitting diode and photodiode whereby light from said light emitting diode passes through said respective openings into said photodiode.

* * * * *